United States Patent [19]

Kojima

[11] Patent Number: 5,052,299

[45] Date of Patent: Oct. 1, 1991

[54] PLATE CLAMPING APPARATUS FOR A LEAF-TYPE PRINTING MACHINE

[75] Inventor: Yasutaka Kojima, Tokyo, Japan

[73] Assignee: Akiyama Printing Machine Manufacturing Company Ltd., Tokyo, Japan

[21] Appl. No.: 453,852

[22] Filed: Dec. 20, 1989

[30] Foreign Application Priority Data

Mar. 30, 1989 [JP] Japan ..... 1-78923

[51] Int. Cl.[5] ..... B41F 27/12

[52] U.S. Cl. ..... 101/415.1; 101/378

[58] Field of Search ..... 101/415.1, 378, 410, 101/383, 385, 386, 378

[56] References Cited

U.S. PATENT DOCUMENTS

| | | | |
|---|---|---|---|
| 3,702,098 | 11/1972 | Eburn, Jr. | 101/378 |
| 3,795,193 | 3/1974 | John et al. | 101/415.1 |
| 3,839,961 | 10/1974 | Murata | 101/415.1 |
| 4,596,188 | 6/1986 | Bonomi | 101/383 |
| 4,836,112 | 6/1981 | Moore | 101/486 |
| 4,935,683 | 6/1990 | Kobler et al. | 101/148 |
| 4,938,135 | 7/1990 | Wieland | 101/415.1 |
| 4,977,833 | 12/1990 | Inage et al. | 101/415.1 |
| 5,003,878 | 4/1991 | Dorow et al. | 101/415.1 |

*Primary Examiner*—Edgar S. Burr
*Assistant Examiner*—John S. Hilten
*Attorney, Agent, or Firm*—Bauer & Schaffer

[57] ABSTRACT

A plate clamping apparatus for a leaf-type printing machine which enables substantially automatic plate clamping and stretching operations. Top and bottom side plate clamps are respectively provided with upper and lower teeth for clamping and releasing the top and bottom side end of a plate by rotating top and bottom side cam shafts. A plate stretcher moves the bottom side plate clamp in a stretching direction or a releasing direction of the plate by rotating a plate stretching cam. Top and bottom side cam followers are respectively coupled by a joint to transmit rotation to the top and bottom cam shafts. A motive force transmitting mechanism is attached to a rotating shaft of the plate roller. A groove cam puts the top and bottom side cam followers into a predetermined action for rotating the top and bottom side cam shafts.

3 Claims, 13 Drawing Sheets

PLATE CLAMPING APPARATUS FOR A LEAF-TYPE PRINTING MACHINE

BACKGROUND OF THE INVENTION

1. Field of the Invention

This invention relates to a plate clamping apparatus for a leaf-type printing machine, and more particularly to a plate clamping apparatus of this kind which can facilitate plate clamping and stretching operations.

2. Description of the Prior Art

When a given printing job has been completed and before the next one is to be done, it is necessary to replace the plate or master on the peripheral surface of the plate roller. Such plates are generally replaced by a manual operation in a procedure that will be explained hereinafter with reference to FIGS. 1 to 4.

In FIG. 1 there is illustrated a plan view of a conventional manual plate clamping apparatus 1, for a leaf-type printing machine. The clamping apparatus 1, is accommodated in a recess axially formed in a plate roller 2.

The clamping apparatus 1, includes, as its main constituents, a top side clamp 4 and a bottom side clamp 5 for attaching the plate 19 and a plate stretcher 12 provided for stretching the plate 2 wound on the plate roller 2. The top side clamp 4 has lower tooth 20 and upper tooth 21, the latter being divided into four parts. A spring 22 and a top side cam shaft 6 are interposed between the lower and upper teeth 20 and 21. The teeth 20 and 21 and the cam shaft 6 are adjustably bolted by a spherical-headed bolt 23. The lower tooth 20 is provided with a bolt 24 for fine adjustment.

The bottom side clamp 5 includes a lower tooth 25 and an upper tooth 26, the latter being divided into four parts. A spring 2 and a bottom side cam shaft 7 are interposed between the teeth 25 and 26. The lower and upper teeth 25 and 26 and the cam shaft 7 are adjustably bolted by a spherical-headed bolt 28. The lower tooth 25 is provided with a bolt 29 for fine adjustment.

Further, a plate stretching cam shaft 13 is disposed between the bottom side lower tooth 25 and a groove 30 formed on the plate roller 2. Also, a spring 31 is inserted between the top side lower tooth 20 and the bottom side lower tooth 25. Such arrangement allows the tip of the fine adjustment bolt 29 to be in contacted with the plate stretching cam shaft 13.

In the conventional manual plate clamping apparatus constructed as described above, the plate 19 is attached and removed, as shown in FIGS. 2 and 3, by manually rotating the cam shafts 6 and 7 with tools (not shown) which are suspended on tool suspenders 32 and 33 arranged at an axially central portion of the cam shafts 6 and 7, respectively.

Further, the plate is stretched by manually rotating the plate stretching cam shaft 13 with a tool (not shown) suspended on an end portion of the cam shaft 13.

Winding the plate 19 on the peripheral surface of the plate roller 2 is explained in detail with reference to FIGS. 2 to 4.

First, the plate clamping apparatus 1' is placed a condition shown in FIG. 2. Specifically, tools are suspended on the tool suspenders 32 and 33 to direct notches **6*a* and 7*a* of the cam shaft 6 and 7 in the upward direction. The top side and bottom side upper teeth 21 and 26 are thus lifted by the bracing force of the springs 22 and 27, respectively, with the spherical-headed bolts 23 and 28 as fulcrum. A gap is consequently formed between the top side lower and upper teeth 20 and 21 and the bottom side lower and upper teeth 25 and 26. Further, a tool is hooked on a peg 34 to direct a notch 13*a* of the plate stretching cam shaft 13 toward the top of the fine adjustment bolt 29. The spring 31 urges the top of the bolt 29 to the cam shaft 13, whereby the bottom side clamp 5 is biased on the left side (see FIG. 2**).

Next, the plate roller 2 is rotated to a position which facilitates attachment of the plate 19 to the top side clamp 4. Then, the top side edge **19*a* of the plate 19 is inserted between the lower and upper teeth 20 and 21, and the cam shaft 6 is manually rotated in the clockwise direction to close the upper tooth 21, thereby clamping the top side edge 19*a***.

When the top side edge **19*a* has been clamped by the top side clamp 4, the plate roller 2 is rotated to a position which facilitates attachment of the plate 19 to the bottom side clamp 5, while the plate is closely contacted on the peripheral surface of the plate roller 2. In this condition, the bottom side edge 19*b* is inserted between the lower and upper teeth 25 and 26, and then the cam shaft 7 is manually rotated in the counterclockwise direction to close the upper tooth 26, thereby clamping the bottom side edge 19*a* (see FIG. 3**).

When both edges **19*a* and 19*b* have been clamped by the top and bottom side clamping portions 4 and 5, the plate stretching cam shaft 13 is manually rotated in the counterclockwise direction to move the bottom side clamp 5 to the right side of FIG. 14 as well as closely contact the plate 19 on the peripheral surface of the plate roller 2, thereby completing attachment of the plate 19 on the peripheral surface of the plate roller 2 (see FIG. 4**).

Removal of the plate 19 may be effected in the reverse order of the above mentioned plate attaching procedure.

As described above, manual replacement of the plate 19 takes a long time, particularly in the case of a multicolored printing machine, thus presenting a problem in that the working ratio of the leaf-type printing machine cannot be improved.

Plate clamping and plate stretching operations, within a plate replacement procedure, are carried out by an operator who is required to manipulate tools in a small area. As a result, the operator has to carry out dangerous work with a bad posture. To solve such problems, there are known Japanese Patent Prepublications Nos. 67051/1987 (Prior art 1) and 164539/1987 (Prior art 2) and Japanese Utility Model Prepublication No. 47134/1988 (prior art 3).

Prior art 1 provides a plate stretching operation without the necessity of manual operation. However, the position at which the plate is to be stretched is determined by the position at which a coupler and a drive for moving the coupler are attached to a frame. It is thus difficult to select a proper position at which the plate clamping operation can be easily carried out.

Prior Art 2 eliminates a manual operation only in the plate clamping procedure while the plate stretching operation still requires a manual operation. Furthermore, depending upon the installed position of the apparatus, the plate must be clamped at a fixed position, making it quite difficult to freely adjust the working position in order to facilitate the plate clamping operation when the top end **19*a* of the plate 19 is inserted between the top side lower and upper teeth 20 and 21 as well as when the bottom end 19***b* is inserted between the bottom side lower and upper teeth 25 and 26.

Prior Art 3 can only eliminate the manual operation in the plate clamping procedure, similar to Prior Art 2. The plate stretching procedure must be manually carried out. Also, the working position is fixed depending upon the installed position of the automatic plate clamping apparatus. Consequently, it is difficult to freely adjust the working position in order to facilitate the plate clamping procedure when the top end 19*a* is thereafter inserted between the upper teeth 20 and 21 as well as when the bottom end 19*b* is inserted between the lower and upper teeth 25 and 26, as described above.

OBJECTS AND SUMMARY OF THE INVENTION

In view of the problems mentioned above, it is an object of the present invention to provide a plate clamping apparatus for a leaf-type printing machine which can easily accomplish a plate clamping operation substantially without the necessity of manual operation and therefore does not lower the working ratio.

It is another object of the present invention to provide a plate clamping mechanism for a leaf-type printing machine which can freely change the working position for plate clamping.

It is a further object of the present invention to provide a plate clamping apparatus for a leaf-type printing machine which can easily accomplish a plate stretching operation without manual operation, to freely change the working position for plate stretching and which therefore does not decrease the working ratio.

To achieve the above objects, there is provided a plate clamping apparatus for a leaf-type printing machine having, in a recess formed in a plate roller thereof, a top side plate clamping means provided with upper and lower teeth for clamping and releasing the top side end of a plate by rotating a top side cam shaft, a bottom side plate clamping means having upper and lower teeth for clamping and releasing the bottom side end of the plate by rotating a bottom side cam shaft, and a plate stretching means for moving the bottom side plate clamping means in a stretching direction or a releasing direction of the plate by rotating a plate stretching cam. The plate clamping apparatus comprises:

a top side cam follower means and a bottom side cam follower means respectively coupled to transmit rotation to the top side cam shaft and the bottom side cam shaft;

motive force transmitting means provided for rotating the shaft of the plate roller; and grooved cam means for providing the top side cam follower means and the bottom side cam follower means with a predetermined action to rotate the top side cam shaft and the bottom side cam shaft.

DETAILED DESCRIPTION OF THE PREFERRED EMBODIMENTS

Figure 1:
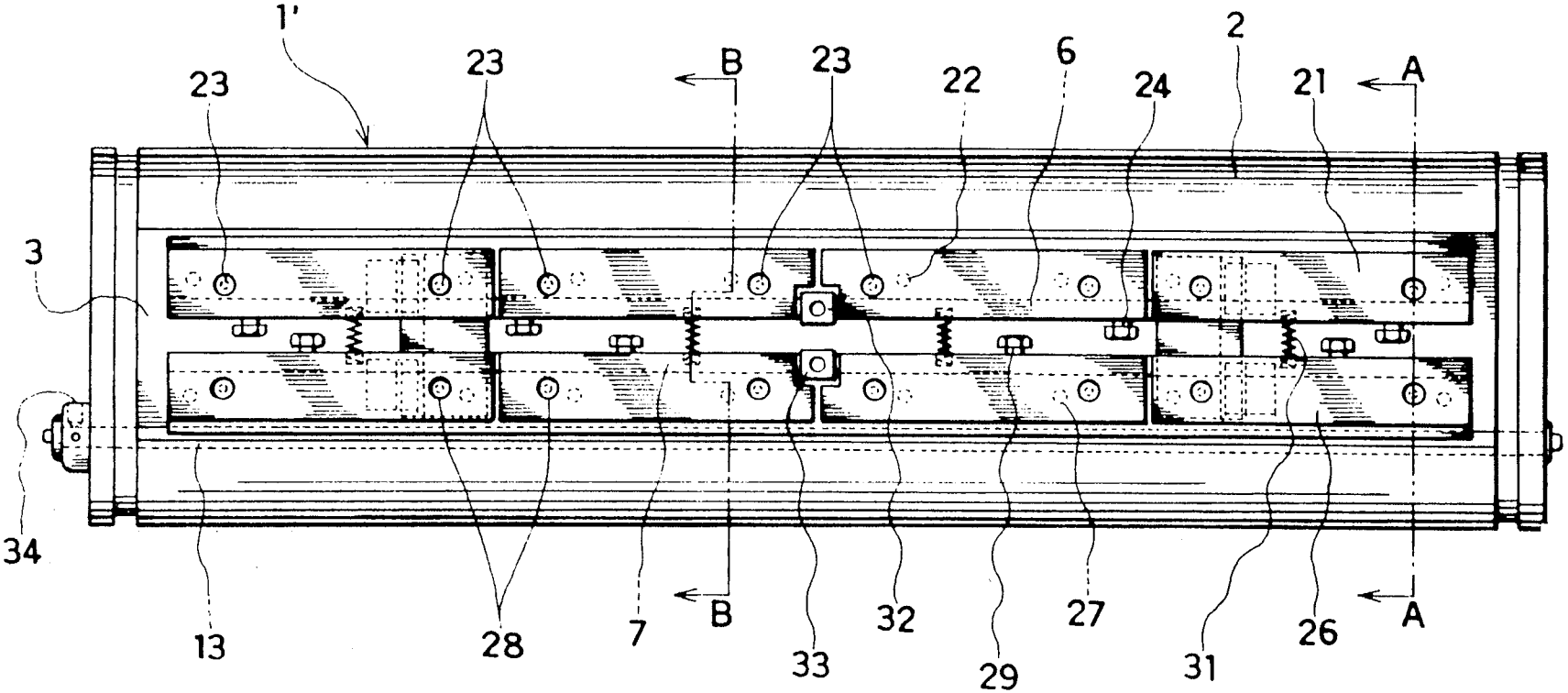
FIG. 1 is a plan view showing a conventional manual plate clamping apparatus for a leaf-type printing machine.
Figure 2:
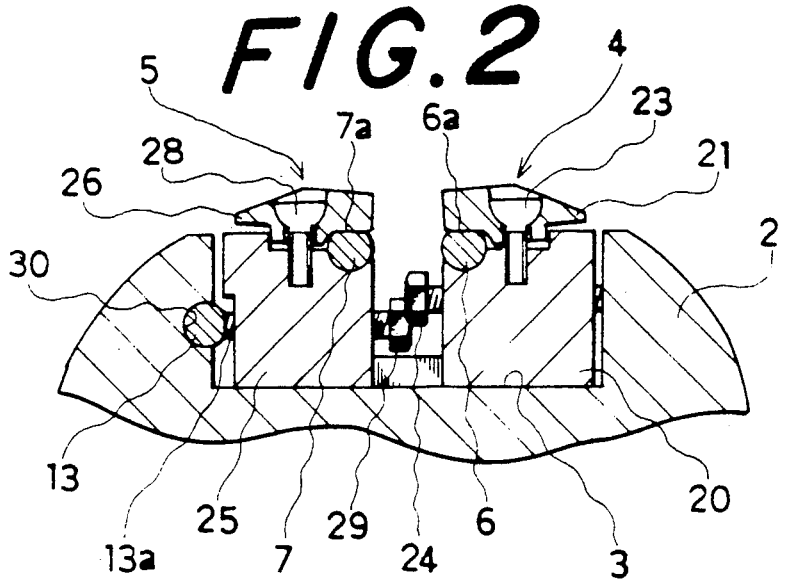
FIG. 2 is a cross-sectional view taken along a line A—A in FIG. 1 showing that the top side upper and lower teeth are opened.
Figure 3:
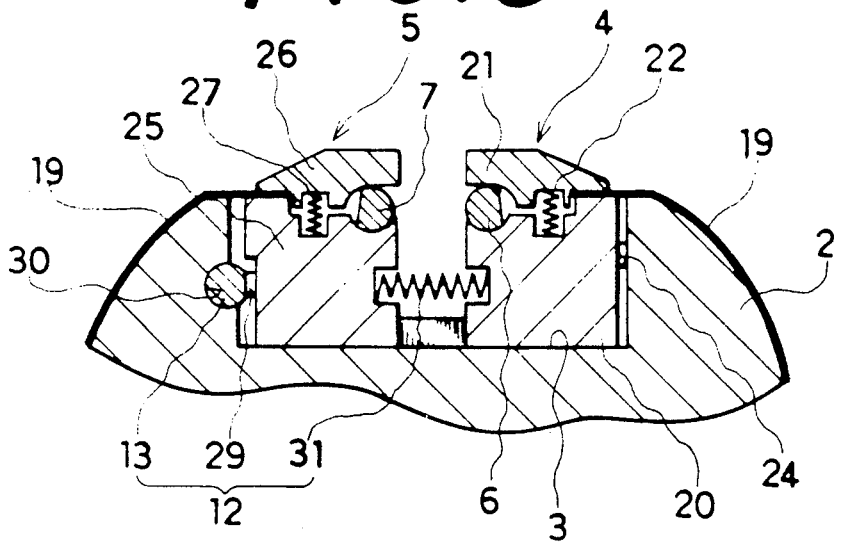
FIG. 3 is a cross-sectional view taken along a line B—B in FIG. 1 showing that the top side and bottom side upper teeth are closed to clamp a plate.
Figure 4:
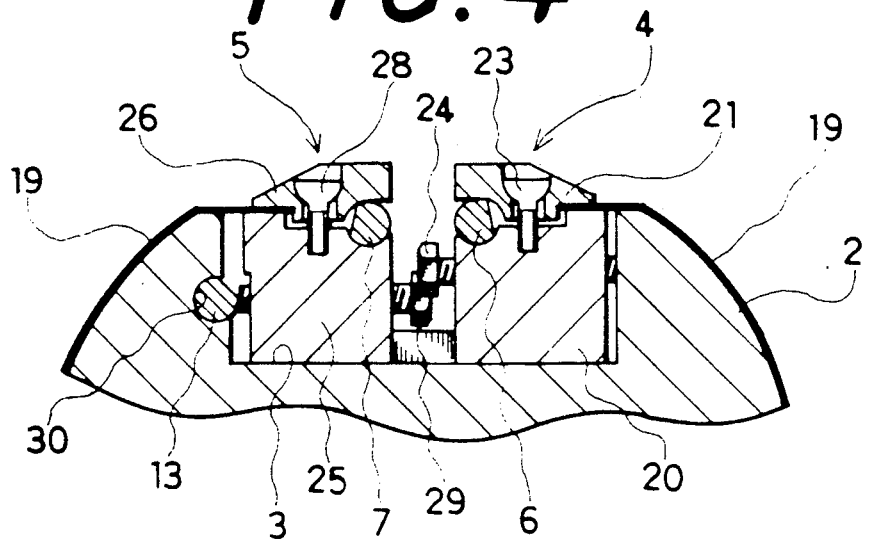
FIG. 4 is a cross-sectional view taken along the line A—A in FIG. 1 showing that the plate stretching cam is rotated to stretch a plate.
Figure 5:
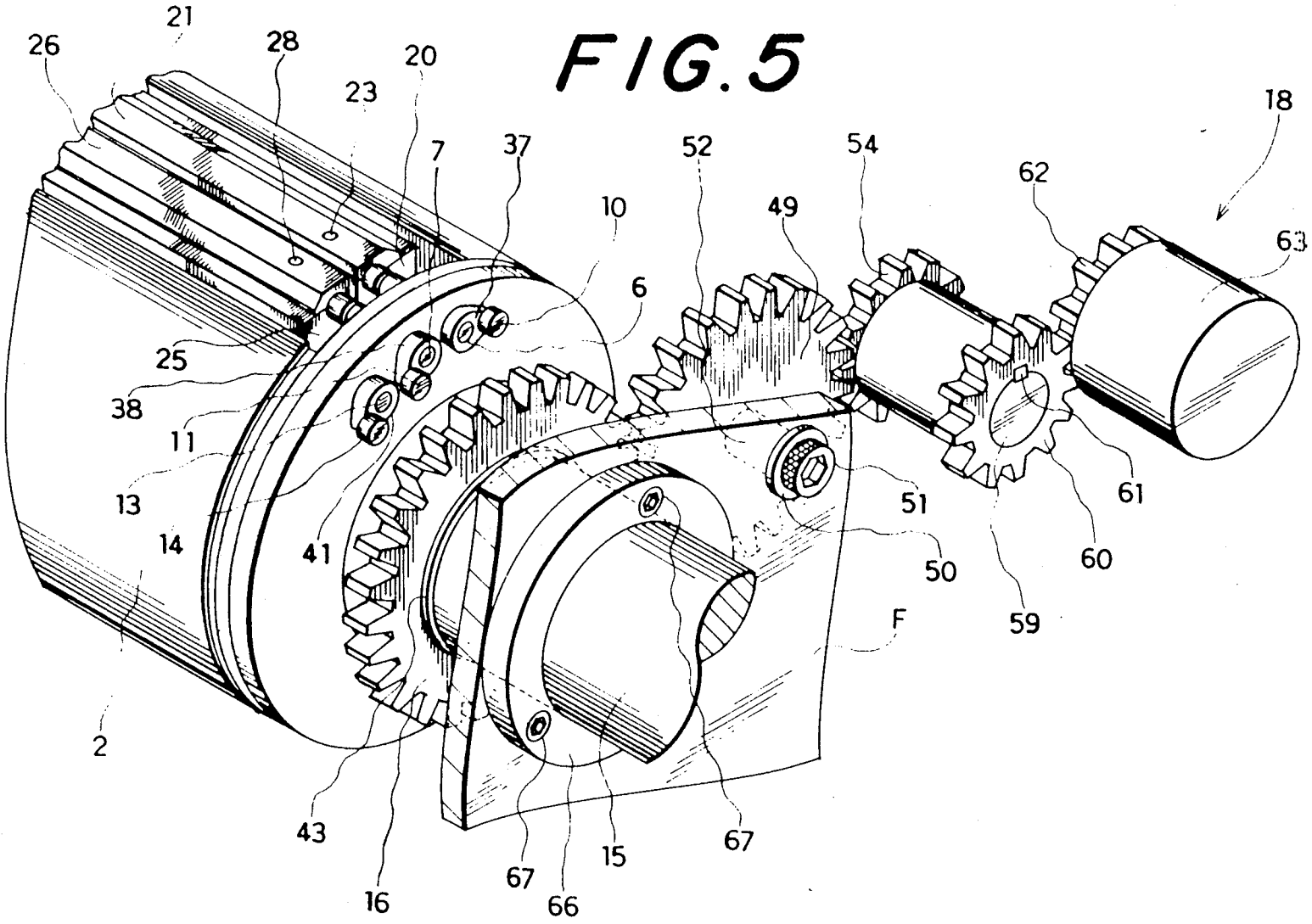
FIG. 5 is a perspective view showing a plate clamping apparatus for a leaf-type printing machine according to the present invention.

One embodiment of the present invention will hereinafter be described with reference to FIGS. 5 to 14.

In these drawings, the plate clamping apparatus for a leaf-type printing machine 1 (hereinafter simply called "the plate clamping apparatus") includes joints 8, 9 for transmitting rotation to plate clamping shafts 6, 7 of the respective top and bottom side plate clamps 4, 5 which are disposed in a recess 3 formed in the plate roller 2. Cam followers 10, 11 coupled to the joints 8, 9, respectively, and a plate stretching cam follower 14 is coupled to a plate stretching cam shaft 13 of a plate stretcher 12 disposed in the recess 3 for transmitting rotation thereto. A first gear (a motive force transmitter) 16 is disposed, to be fixed to a rotating shaft 15 of the plate roller 2 when a torque is below a predetermined value and rotatable when a torque is above the predetermined value. A groove cam 17 is secured to the first gear 16 for providing a predetermined motion to the cam followers 10, 11 and 14, so as to rotate the cam shafts 6, 7 and 13, respectively. A drive 18 provides the first gear 16 with a torque above the predetermined value to thereby rotate the same to a predetermined position.

The top and bottom side plate clamps 4, 5 and the plate stretcher 12 are constructed in the same manner as the aforementioned prior art example, so that a detailed description thereof will be omitted.

The joints 8, 9 comprise A joints 8*a*, 9*a* and B joints 8*b*, 9*b*, respectively. The A joints 8*a*, 9*a* are respectively inserted into holes 6*a*, 7*a* formed in an end portion of the cam shafts 6, 7 and secured by taper pins 35, 36, respectively. The B joints 8*b*, 9*b* have a recess on one end thereof which are transversely fit slidably in a protrusion of the A joints 8*a*, 9*a*. Intermediate portions of the B joints are rotatably inserted in holes formed in the plate roller 2 while the other ends thereof are secured to levers 37, 38 by taper pins 39, 40, respectively.

The cam followers 10, 11 are attached to the levers 37, 38, respectively by a nut.

The plate stretching cam shaft 13 has its end portion projecting from the side surface of the plate roller 2, to which one end of the lever 41 is secured by a taper pin 42. To the other end of the lever 41 there is attached the plate stretching cam follower 14 by a nut.

The first gear 16 is rotatably fitted to the rotating shaft of the plate roller 2, and is prevented from axially moving by a stopper ring 43. The side surface of the first gear 16 is provided with three engaging holes 16*a* formed with a predetermined space therebetween. Engaged with these holes 16*a* are balls 46 inserted in an open end of a ball plunger 44 and urged by a spring 45. The ball plunger 44 is secured to an end of a bracket 47 which is bolted to the side surface of the plate roller 2. With such structure, when a torque below a predetermined value is produced by the first gear 16, the ball 46 of the ball plunger 44 is engaged into the hole 16*a*, whereby the first gear 16 is rotated together with the rotating shaft 15 of the plate roller 2. On the other hand, when a torque above the predetermined value is produced, the ball 46 of the ball plunger 44 decouples from the hole 16*a*, against the urging force of the spring 45, so that the first gear 16 is rotated around the rotating shaft 15 of the plate roller 2.

The groove cam 17 is bolted to the side surface of the first gear 16, and disposed to move the cam followers 10, 11 and 14. Specifically, the top side upper tooth 21 is opened when the cam follower 10 remains at a position indicated by a solid line in FIG. 6, and closed when at a position indicated by a two-dot chain line. Also, the bottom side upper tooth 26 is opened when the cam follower 11 is at a position indicated by a solid line in FIG. 6, and closed when at a position indicated by a two-dot chain line.

Figure 6:
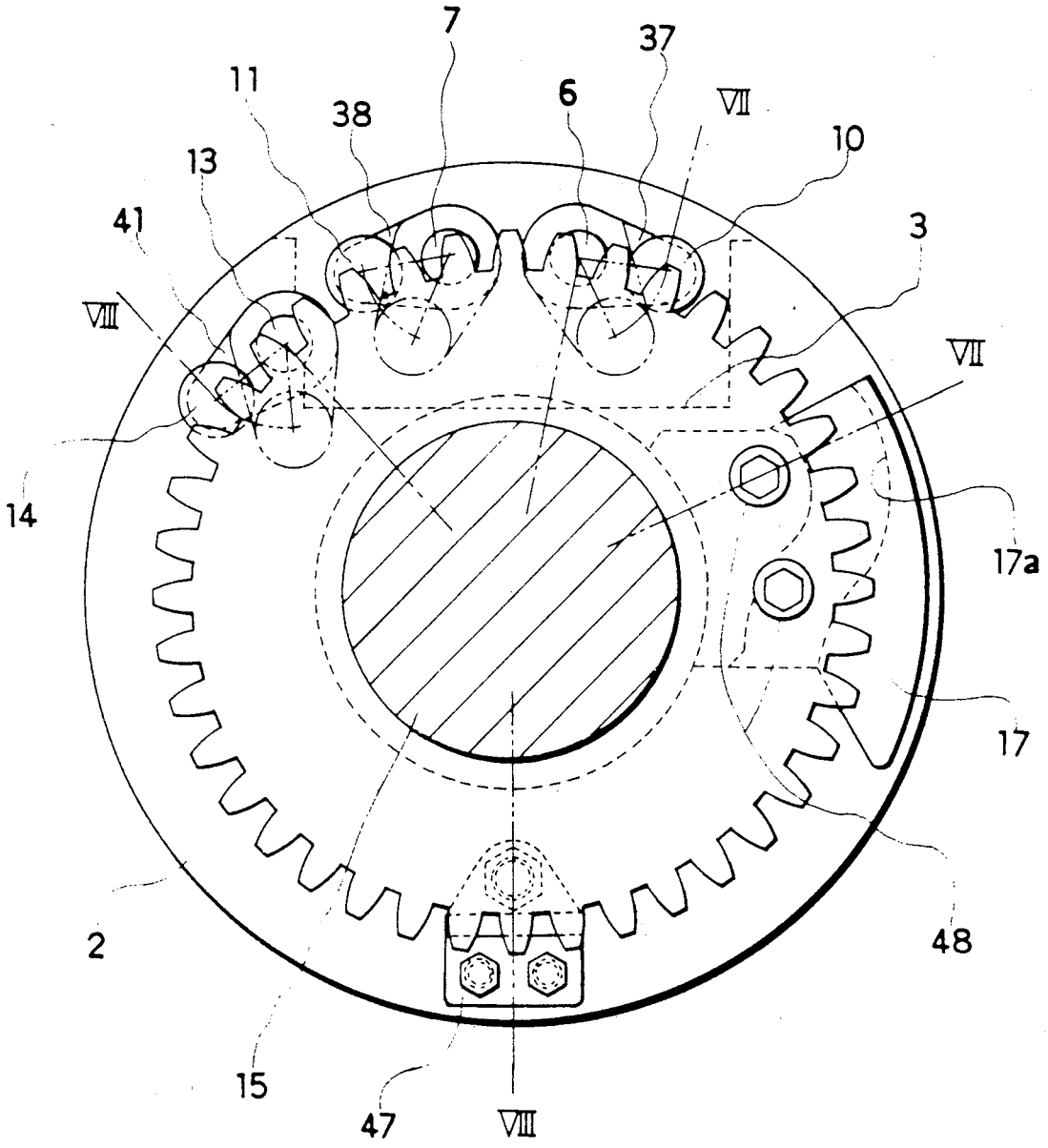
FIG. 6 is a cross-sectional view taken along a line VI—VI in FIG. 7.
Figure 7:
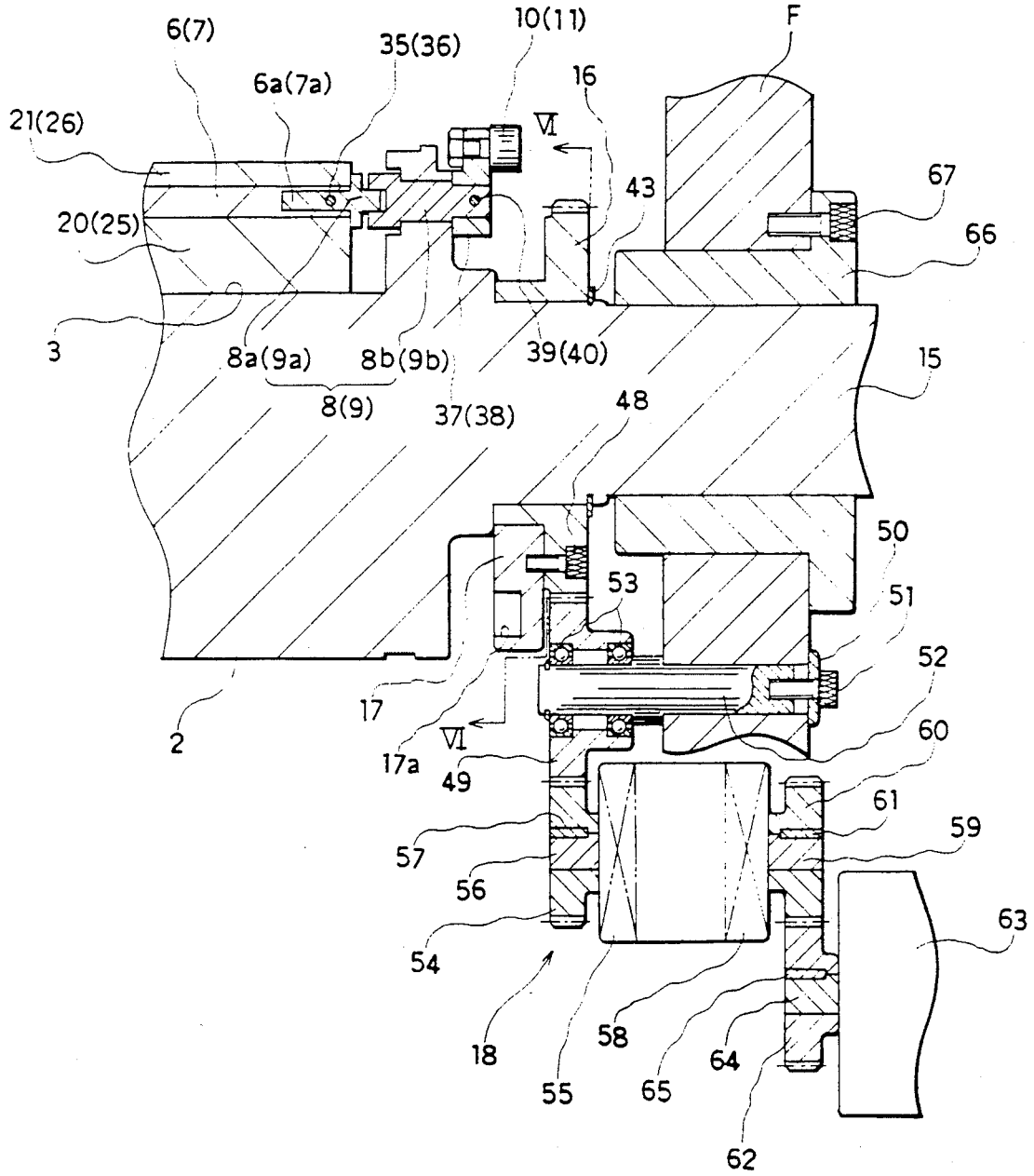
FIG. 7 is a cross-sectional view taken along a line VII—VII in FIG. 6.
Figure 8A:
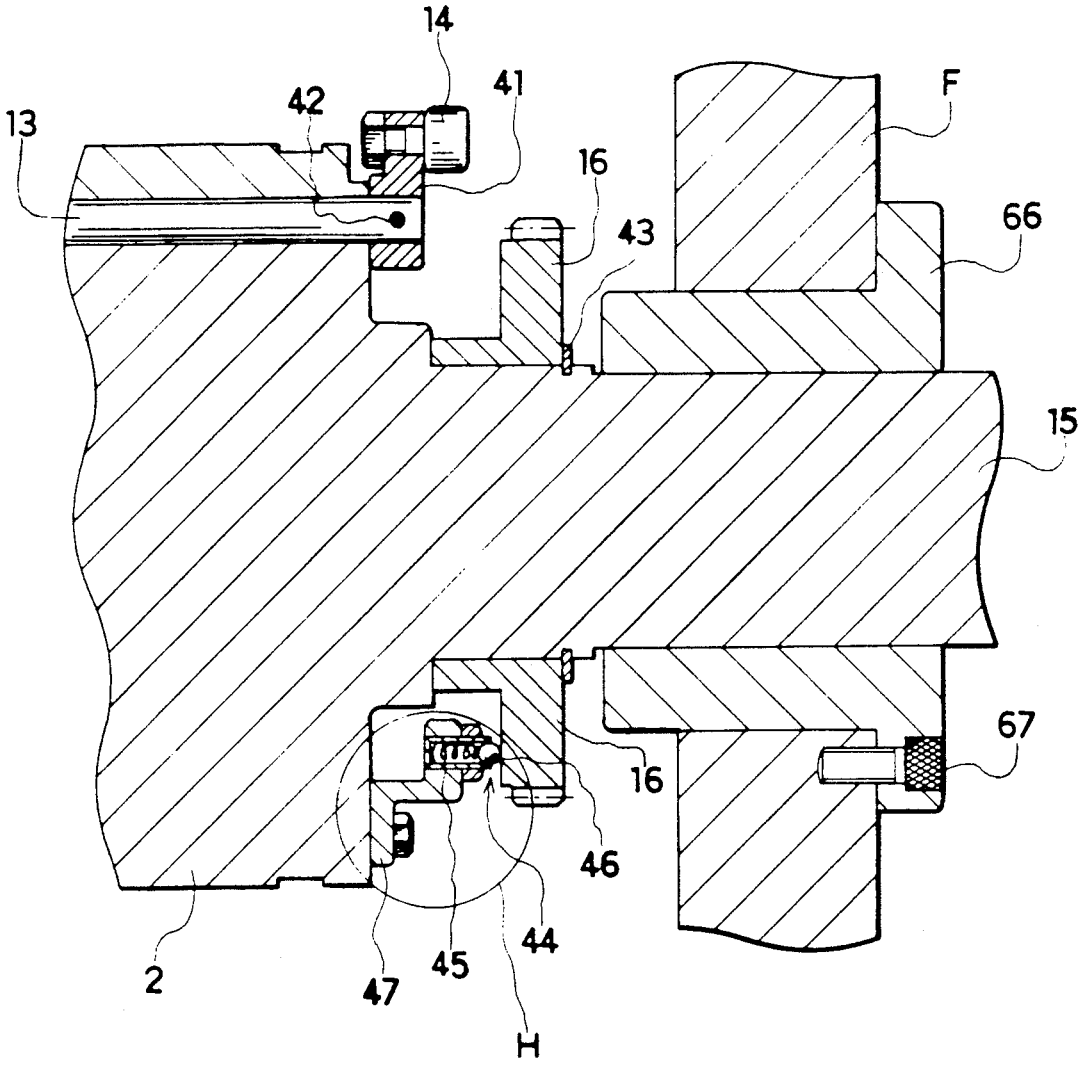
FIG. 8 is a cross-sectional view taken along a line VIII—VIII in FIG. 6.
FIG. 8B is an enlarged cross-sectional view of a portion H in FIG. 8A.
Figure 8:
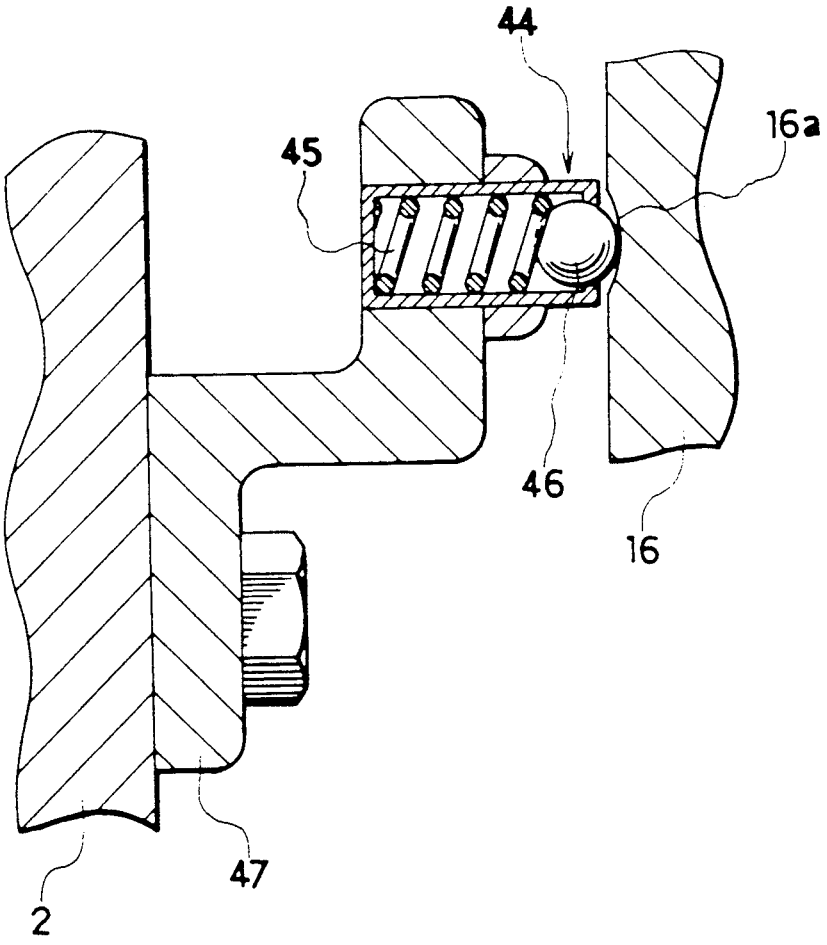

When the plate stretching cam follower 14 is at a position indicated by a solid line in FIG. 6, the bottom side plate clamp 5 is offset to the left side, that is, in a condition where the plate 19 is not stretched. On the contrary, when it is at a position indicated by a two-dot chain line, the clamp 5 is offset to the right side where the plate 19 is stretched.

The drive 18 has a second gear 49 which is disposed to be engaged with the first gear 16. The second gear 49 is journalled in a ball bearing 53 about a pin 52 which is secured to the main body frame F by a washer 50 and a bolt 51. The second gear 49 is engaged with a third gear 54 which is secured to a clutch shaft 56 of a clutch 55 by a key 57. The clutch 55 is integrated with a brake 58. The brake 58 has a brake shaft 59 to which a fourth gear 60 is secured by a key 61. Further, a fifth gear 62 is disposed to be engaged with the fourth gear 60 and secured to a motor shaft 64 of a motor 63 by a key 65.

Reference numeral 66 designates a bearing for supporting the rotating shaft 15 of the plate roller 2 which is firmly bolted to the main body frame F by a bolt 67.

The operation of the plate clamping apparatus as described above will be explained in detail with reference to FIGS. 9A, 9B, 10A, 10B and 10C.

Figure 9A:
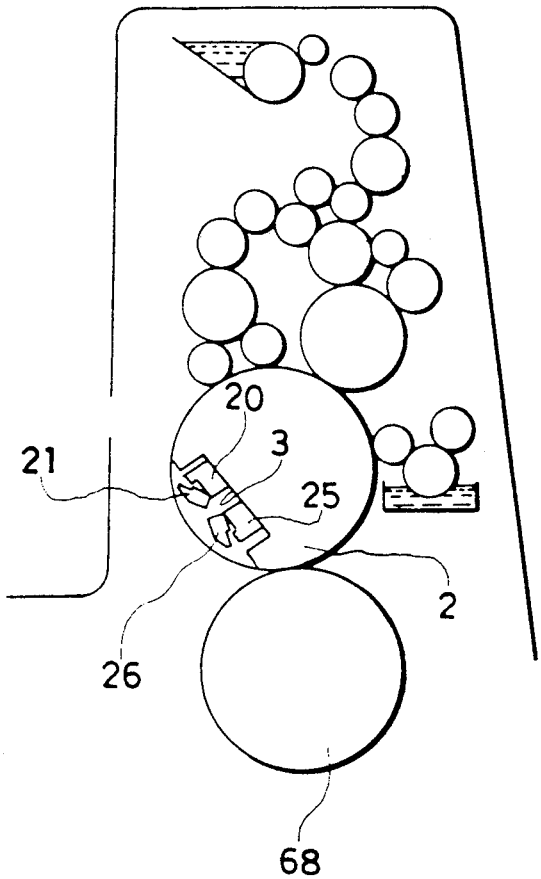
FIGS. 9 through 14 are cross-sectional views used for explaining a procedure of mounting and stretching a plate on the surface of a plate roller.

FIG. 9A shows a ready condition, i.e. a condition where the top and bottom side upper teeth 21, 26 are opened. The bottom side plate clamp 5 is offset toward the plate stretching cam shaft 13 in the recess 3 of the plate roller 2. When the motor 63 is stopped and the brake 58 is operated, the clutch 55 is opened, and the ball 46 of the ball joint 44 is engaged with the hole 16*a* of the first gear 16. In this condition, a switch (not shown) for attaching a plate is turned on to rotate the plate roller 2 to a position at which the plate 19 can be easily attached to the top side plate clamp 4, that is, a position shown in FIG. 9A. Then, the switch is turned off.

In FIG. 6A, the plate roller 2 is at the same position as shown in FIG. 5A. In this condition, the top end 19*a* of the plate 19 is inserted between the top side lower and upper teeth 20, 21. The brake 58 is then opened by a switch (not shown), and the clutch 55 and the motor 63 are operated, and rotation produced by the motor 63 is transmitted to the first gear 16 through the fifth, fourth, third and second gears 62, 60, 54 and 49. The torque produced by the first gear 16 allows the ball 46 of the ball joint 44 to be disengaged from the hole 16*a* of the first gear 16, whereby the plate roller 2 and the first gear 16 decouple and the first gear 16 is rotated in the counterclockwise direction, together with the groove cam 17.

Figure 9B:
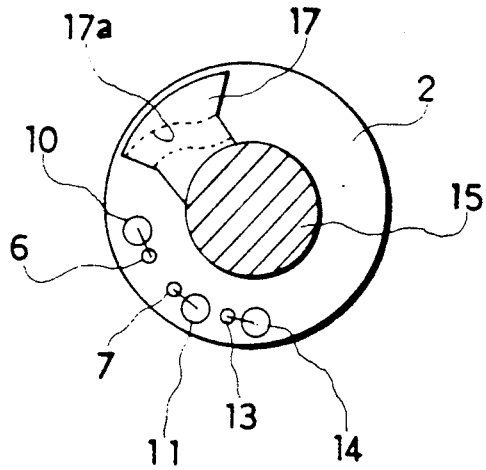
Figure 10A:
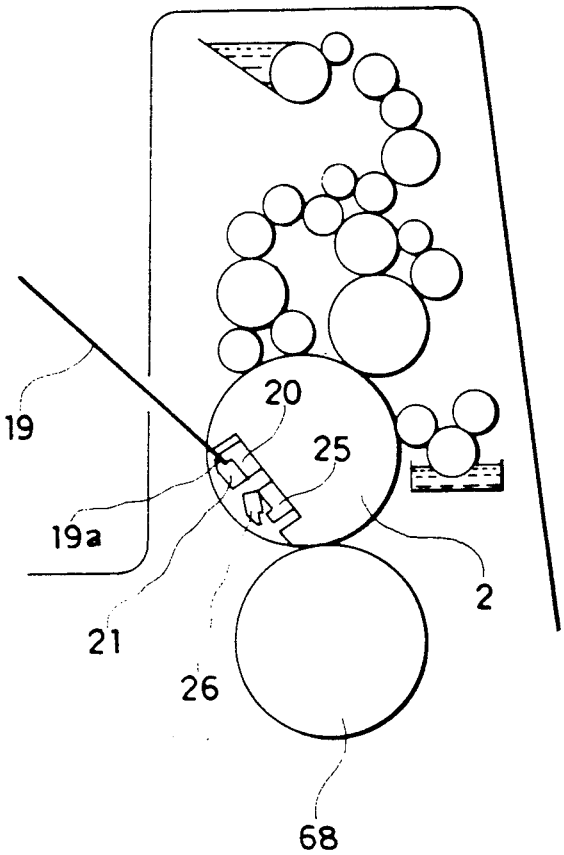
Figure 10B:
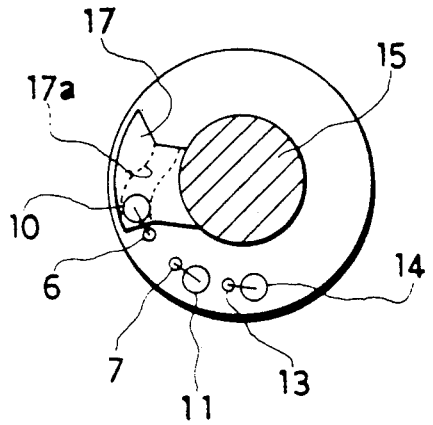
Figure 10C:
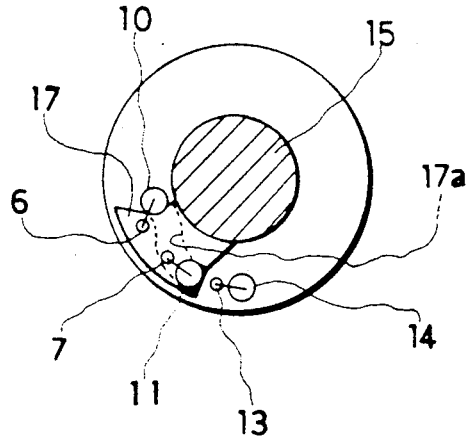

When the groove cam 17, rotated from a position shown in FIG. 9B, comes to a position shown in FIG. 10B, the top side cam follower 10 enters the groove cam 17 from the upper end of a wave-shaped groove 17*a*. When the groove cam 17 is further rotated to a position shown in FIG. 10C, the cam follower 10 comes off the groove 17 from the lower end of the wave-shaped groove 17*a*.

When the top side cam follower 10 reaches this position, i.e., the position indicated by the two-dot chain line in FIG. 6, the top side upper tooth 21 is closed clamping the top end 19*a* of the plate 19. When the groove cam 17 comes to the position shown in FIG. 10C, a detector (not shown), for example, a tachometer attached to the fifth gear 62 secured to the motor shaft 64, is operated, the motor 63 is stopped, and the ball 46 of the ball joint 44 is engaged with the hole 16*a* of the first gear 16. As a result, the plate roller 2 couples with the first gear 16, the clutch 55 is opened and the brake 58 is operated. The groove cam 17 is stopped at the position shown in FIG. 10C, thus completing a procedure of clamping the plate to the top side plate clamp 4.

Figure 11A:
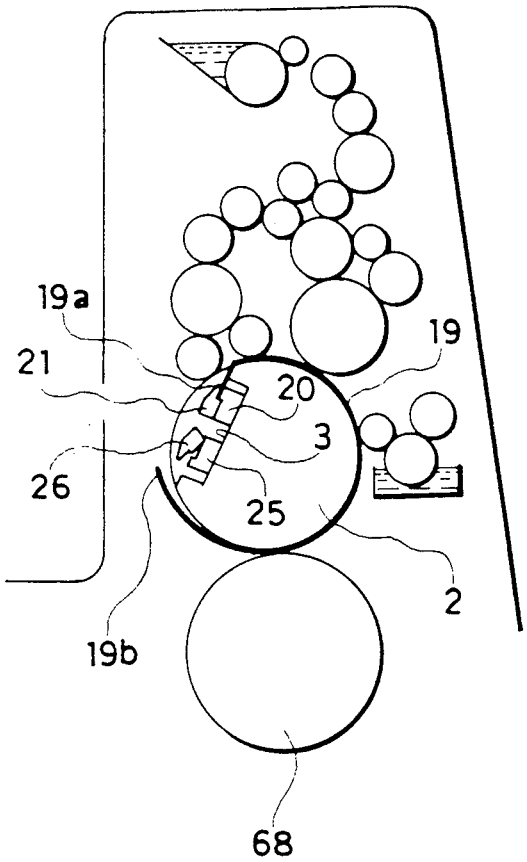
Figure 11B:
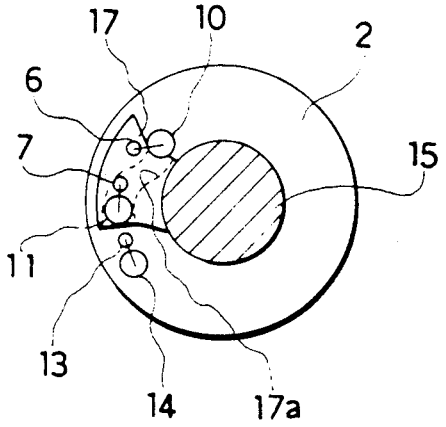

FIG. 11A shows that the bottom side plate clamp 5 is positioned so as to permit the plate 19 to be easily attached. Such condition can be obtained by bringing the plate roller 2 into contact with a blanket roller 68 (a printing condition) and rotating the plate roller 2 (together with the groove cam 17) from the position shown in FIG. 10A in the counterclockwise direction, with the plate 19 closely contacted to the peripheral surface of the plate roller 2. At this time, since the plate roller 2 and the first gear 16 are rotated together, the relationship between the groove cam 17 and the top side cam follower 10 is the same as that shown in FIG. 10C (see FIG. 11B).

Figure 12A:
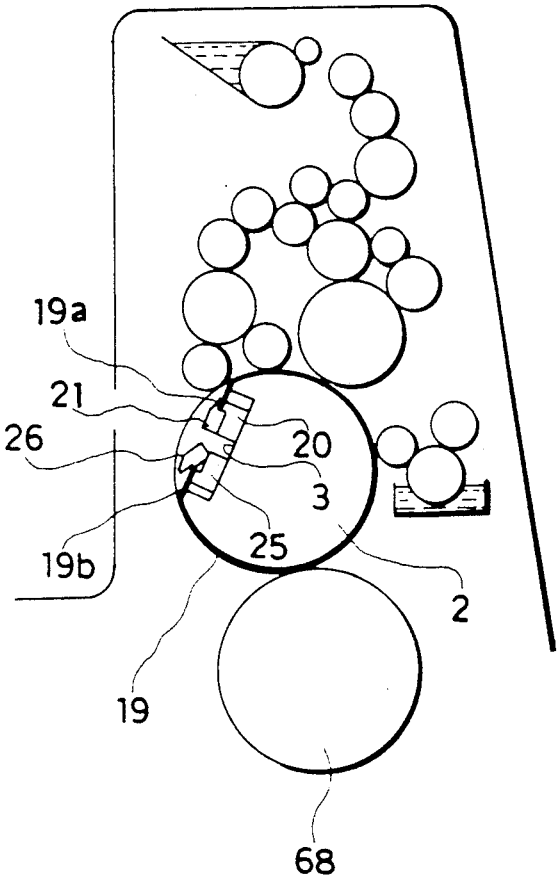
Figure 12B:
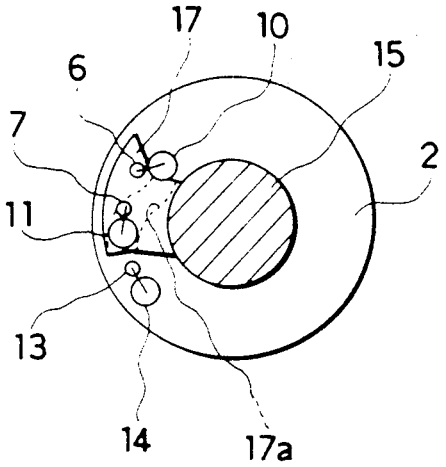

The position of the plate roller 2 in FIG. 12A, in the same manner as that shown in FIG. 11A, illustrates that the bottom end 19*b* of the plate is inserted between the bottom side lower and upper teeth 25, 26. The relationship between the groove cam 17 and the top side cam follower 10, at this time, is the same as those shown in FIGS. 10A and 11B (see FIG. 12B).

Figure 13A:
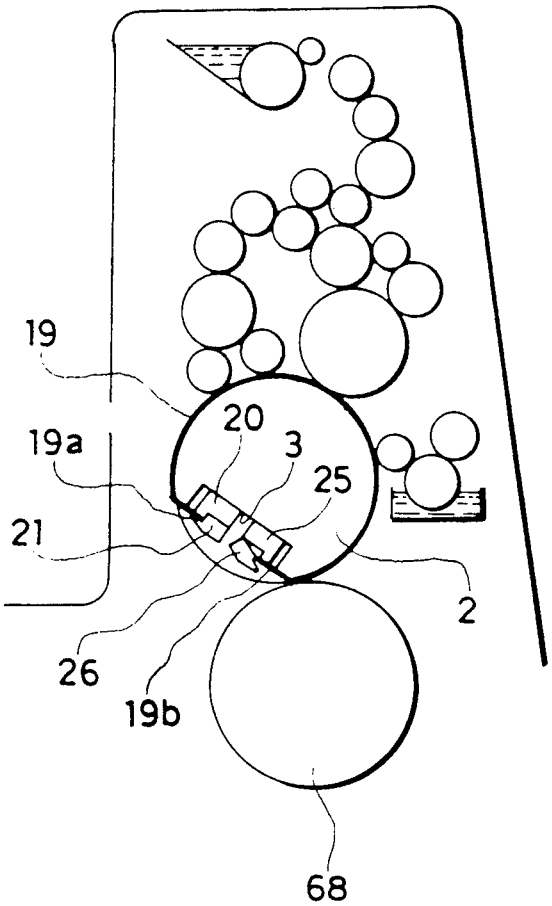
Figure 13B:
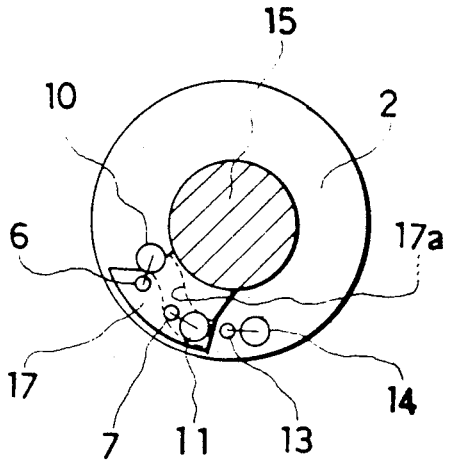

FIG. 13A shows that the plate roller 2, together with the groove cam 17, is again rotated in the counterclockwise direction from the position shown in FIG. 12A to a position where the contact point between the plate roller 2 and the blanket roller 68 is near the bottom side plate clamp 5. This brings the plate 19 into close contact with the peripheral surface of the plate roller 2. The relationship between the groove cam 17 and the top side cam follower 10, at this time, is also the same as those shown in FIGS. 10C, 11B and 12B (see FIG. 13B).

Figure 14A:
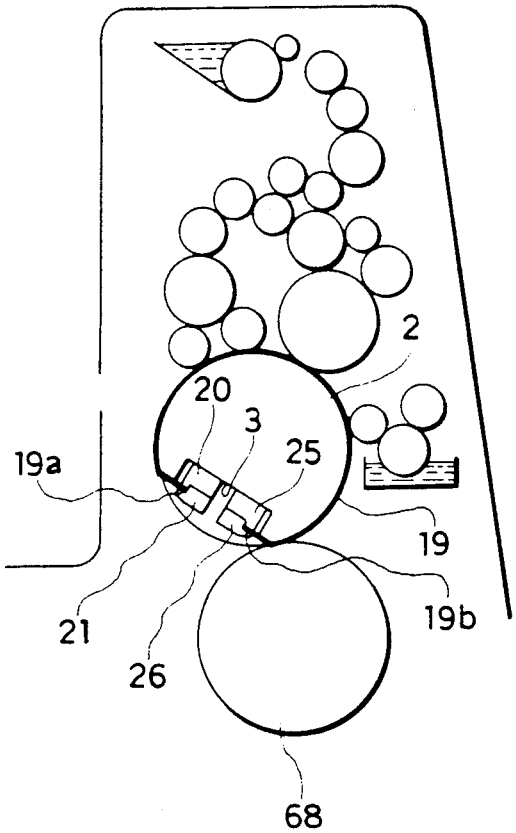
Figure 14B:
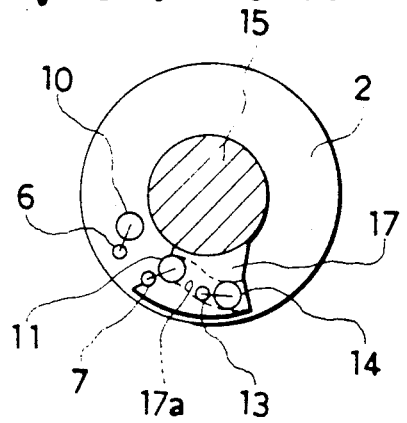

The position of the plate 2 shown in FIG. 14A is the same as that shown in FIG. 13A. When the plate roller 2 comes to this position, the detector (not shown) is operated, the brake 58 is opened, and the clutch and the motor 63 are operated, whereby rotation of the motor 63 is transmitted to the first gear 16 through the fifth, fourth, third and second gears 62, 60, 54 and 49. The torque produced by the first gear 16 disengages the ball 46 of the ball joint 44 from the hole 16*a* of the first gear 16 (i.e., the plate roller 2 and the first gear 16 decouple. As a result, the first gear 16 is rotated in the counter-clockwise direction, together with the groove cam 17. When the groove cam 17 is rotated from the position shown in FIG. 13B to a position shown in FIG. 14B, the bottom side cam follower 11 comes off the groove cam 17 from the lower end of the wave-shaped groove 17*a*. When the cam follower 11 comes to this position, the bottom side upper tooth is closed to clamp the bottom end 19*b* of the plate 19, thereby completing a procedure of clamping the plate 19 by the bottom side plate clamp 5.

Figure 14C:
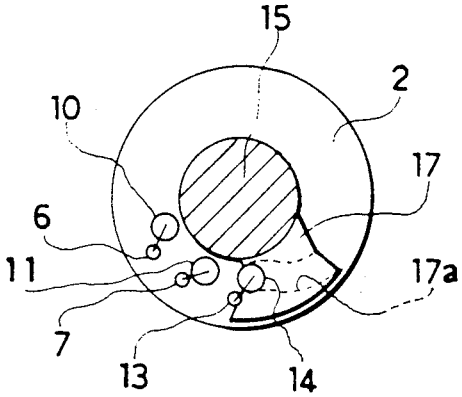

When the groove cam 17 is further rotated to be positioned as shown in FIG. 14C, the plate stretching cam follower 14 comes off the groove cam 17 from the lower end of the wave-shaped groove 17*a*. When the cam follower 14 is at this position, the bottom side plate clamp 5 is moved toward the center of the recess 3 of the plate roller 2 for stretching the plate 19.

Figure 14D:
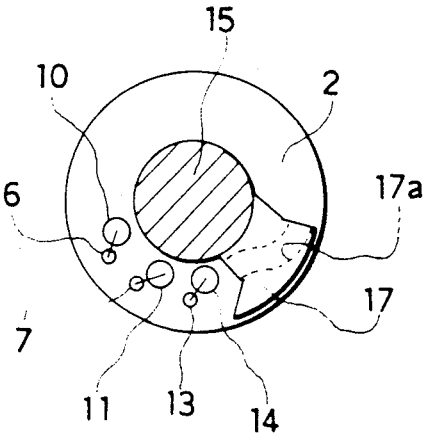

When the groove cam 17 is further rotated to be at a position shown in FIG. 14D, the detector (not shown) is operated, the motor 63 is stopped, the brake 58 is operated, and the clutch 55 is opened, whereby the ball 46 of the ball joint 44 is engaged with the hole 16*a* of the first gear 16. Therefore, the first gear 16 is coupled with the plate roller 2 to stop the groove cam 17 at this position. Then, the plate roller 2 is separated from the blanket roller 68 (non-printing condition), thus completing the attachment of the plate 19.

Next, a procedure of removing the plate 19 from the plate roller 2 will be hereinafter explained.

When a switch (not shown) for plate removal is turned on, the plate roller 2 is stopped at the position shown in FIG. 12A. Then, the aforementioned detector (not shown) is operated, the brake 58 is opened, and the clutch and the motor 63 are operated, whereby rotation of the motor 63 is transmitted to the first gear 16 through the fifth, fourth, third and second gears 62, 60, 54 and 49. A torque thus produced by the first gear 16 disengages the ball 46 of the ball joint 44 from the hole 16*a* of the first gear 16 (whereby the plate roller 2 and the first gear 16 decouple. The groove cam 17 is rotated in the clockwise direction from the position shown in FIG. 14D to the position shown in FIG. 9B where the detector (not shown) is operated, the motor 63 is stopped, the clutch 55 is opened, and the brake 58 is operated. The ball 46 of the ball joint 46 is engaged with the hole 16*a* of the first gear 16 (the plate roller 2 and the first gear 16 are coupled, and therefore rotation of the groove cam 17 is stopped.

While the groove cam 17 is rotated in the clockwise direction from the position shown in FIG. 14D to the position shown in FIG. 9B, the plate stretching cam follower 14 and the top and bottom side cam followers 10, 11 come off the groove cam 17. Thereby the bottom side plate clamp 5 is brought near the plate stretching cam shaft 13 disposed in the recess 3 of the plate roller 2 (i.e., loosening the plate 19). Then, the plate 9 can be removed from the plate roller 2 by opening the bottom side upper tooth 26 and the top side upper tooth 21.

Incidentally, the present embodiment employs, in addition to a motor for rotating the plate roller 2 (not shown), the motor 63 for rotating the first gear 16 together with the groove cam 17 coupled therewith, with respect to tee plate roller 2. The top side cam shaft 6, the bottom side cam shaft 7 and the plate stretching cam shaft 13 are, rotated by the action of the groove cam 17 to carry out the plate clamping and stretching operations. It should be therefore noted that these actions can be performed independently of the position at which the plate roller 2 is stopped and are not limited to the position shown in the present embodiment.

The conventional plate clamping apparatus 1′ can be easily modified to obtain the plate clamping apparatus 1 of the present invention. If the pegs or tool suspenders 32, 33 and 34 are provided on the top side and bottom side cam shafts 6, 7 and the plate stretching cam shaft 13, it is also possible to manually clamp and stretch a plate, in the same manner as the conventional apparatus 1′, when the groove cam 17 remains at the positions shown in FIGS. 9B and 14D.

In the present embodiment, explanation is given of a case where the printing machine has only one plate roller. However, the plate clamping apparatus 1 of the present invention may be employed in a multi-color leaf-type printing machine. If the plate rollers 2 are stopped at the same angular position, that is, the plate clamping apparatus adapted to the respective plate rollers 2 are stopped at the same angular position, their operations can be effected simultaneously, whereby the time required for the replacement of each of the plates 19 can be largely reduced.

According to the present invention the plate roller is rotated to a position where the top end of a plate can be easily inserted between the top side upper and lower teeth, wherein the top end of the plate is inserted between them. Then, the groove cam is operated by a motive force transmitting mechanism to move the top side cam follower. This action causes the top side cam shaft to be rotated in one direction, through a coupling, whereby the upper tooth is brought toward the lower tooth to hold and clamp the top end of the plate therebetween. Next, the plate is wound around the peripheral surface of the plate roller by rotating the plate roller with the above condition maintained. Next, the plate roller is further rotated to a position where the bottom end of the plate can be easily inserted between the bottom side upper and lower teeth, wherein the bottom end of the plate is inserted between them. Then, the groove cam is operated by the force transmitting mechanism to move the bottom side cam follower. This action causes the bottom side cam shaft to be rotated in one direction, through a joint, whereby the upper tooth is brought toward the lower tooth to hold and clamp the bottom end of the plate therebetween. Incidentally, a plate wound around the plate roller may be removed by performing the above operation in the reverse order.

It is therefore appreciated that the plate clamping operation can be easily and safely carried out without manual operation for a shorter time, with the result that the working ratio of the printing machine can be elevated.

Further, if the plate clamping apparatus of the present invention is employed in a multi-.color leaf-type printing machine, replacement of plates for the respective plate rollers can be simultaneously achieved, so that a time required therefor can be greatly reduced.

When the top end of a plate is inserted between the top side upper and lower teeth and the drive gears are rotated in one direction, the torque above a predetermined value is transmitted to the force transmitting mechanism, whereby the motive force transmitting mechanism is solely rotated in the one direction, and therefore the groove cam secured to the motive force transmitting mechanism puts the top side cam follower into action. This action is transmitted to the top side cam shaft through a coupling to rotate the top side cam shaft in one direction, so that the upper tooth is brought toward the lower tooth to hold and clamp the bottom end of the plate therebetween. Next, when the drive is stopped, the motive force transmitting mechanism produces a torque below the predetermined value and therefore is fixed to the rotating axis of the plate roller. The plate is wound around the plate roller by rotating the plate roller, with this condition maintained. The plate roller is further rotated to a position where the bottom end of the plate can be easily inserted between the bottom side upper and lower teeth. Then, after inserting the bottom end of the plate between the upper and lower teeth, and when the drive is rotated in one direction to give a torque above the predetermined value to the motive force transmitting mechanism, the motive force transmitting mechanism is solely rotated in the one direction, whereby the bottom side cam follower is acted on by the groove cam. This action, transmitted through the coupling to the bottom side cam shaft, causes the same to be rotated in the one direction. Consequently, the bottom side upper tooth is brought toward the lower tooth, thus holding and clamping the bottom end of the plate therebetween. To remove the plate thus wound around the plate roller, the above-described procedure may be effected in the reverse order.

It should therefore be noted that the plate clamping operation can be easily carried out without manual operation and limitation on the plate clamping position, by virtue of another motor employed, in addition to the motor for rotating the plate roller, for rotating the groove cam coupled with the motive force transmitting mechanism with respect to the plate roller.

Further, when the drive is rotated in the one direction after the both ends of a plate have been clamped by the top side and bottom side clamps, the plate stretching cam follower is acted by the groove cam secured to the motive force transmitting mechanism. This action causes the plate stretching cam shaft to be rotated in the one direction to thereby move the bottom side plate clamp in a direction of stretching the plate. For loosening the plate thus stretched, the above described procedure may be effected in the reverse order.

Therefore, the plate stretching operation can also be easily carried out without manual operation and limitation on the plate stretching position, due to another motor employed, in addition to the motor for rotating the plate roller, for rotating the groove cam integrated with the motive force transmitting mechanism with respect to the plate roller.

It will be understood that those skilled in the art may make changes and modifications to the foregoing plate clamping apparatus without departing from the spirit and scope of the invention as set forth in the claims appended hereto.

What is claimed is:

1. Clamping apparatus for leaf-type printing machines having, a plate roller with a recess formed therein, said plate roller being mounted on a rotatable shaft and having sides, a rotatable top side cam shaft and a rotatable bottom side cam shaft, a top side plate clamp having upper and lower teeth mounted in said recess for clamping and releasing a plate by means of said teeth, said clamp being operable by said rotatable top side cam shaft, a bottom side plate clamp having upper and lower teeth for clamping and releasing said plate by means of said bottom side upper and lower teeth, said bottom side plate clamp being operable by said rotatable bottom side cam shaft, and plate stretching means comprising a rotatable plate stretching cam and a plate stretching cam shaft, said plate stretching means moving said bottom side plate clamp in the stretching direction and in the loosening direction by movement of said rotatable plate stretching cam, said clamping apparatus further comprising:

top, bottom, and plate stretching cam followers having respective joints, said top, bottom and plate stretching cam followers respectively coupled to said top, bottom, and plate stretching cam shafts through said respective joints which freely transmit rotating movements, said cam followers respectively disposed on an outer side wall on the plate roller side;

a motion transmitting body arranged to be unmovable when a torque of less than a predetermined value is applied to the rotatable shaft of said plate roller and rotatable when a torque of more than the predetermined value is applied to the rotatable shaft of said plate roller;

driving means for applying to said motion transmitting body a torque of more than said predetermined value; and a grooved cam secured to said motion transmitting body for providing a predetermined action to said top, bottom, and plate stretching cam followers for respectively rotating said top, bottom and plate stretching cam shafts.

2. The apparatus according to claim 1, wherein said grooved cam has a predetermined shape for each of said cam followers to move said cam followers sequentially.

3. The apparatus according to claim 2, wherein said grooved cam and said cam followers cooperate to cause said top side cam shaft to rotate in one direction and the bottom side and plate stretching cam shafts to rotate in an opposite direction.

* * * * *